US006179256B1

(12) United States Patent
Utterback

(10) Patent No.: US 6,179,256 B1
(45) Date of Patent: Jan. 30, 2001

(54) GOLF CLUB CARRIER AND STAND

(76) Inventor: Clifford M. Utterback, deceased, late of Piqua, OH (US), by Mary Jane Weller, heir ( * ) Notice: Under 35 U.S.C. 154(b), the term of this patent shall be extended for 0 days.

(21) Appl. No.: 09/406,323

(22) Filed: Sep. 27, 1999

(51) Int. Cl.[7] ..... F16M 11/24

(52) U.S. Cl. ..... 248/166; 248/170; 248/171; 248/432; 248/424; 248/150; 248/436; 211/70.2; 211/198

(58) Field of Search ..... 248/166, 170, 248/171, 431, 432, 150, 436, 424, 439, 165; 211/70.2, 195, 198

(56) References Cited

U.S. PATENT DOCUMENTS 2,990,865 * 7/1961 Steele ..... 150/1.5
3,215,181 * 11/1965 Reed ..... 150/1.5
3,232,503 * 2/1966 Thonen ..... 224/45
3,483,996 * 12/1969 Scammon ..... 211/60
4,036,416 * 7/1977 Lowe ..... 224/45
4,666,038 * 5/1987 Minneman ..... 206/315.2
5,209,539 * 5/1993 Atalay ..... 294/143
5,492,384 * 2/1996 Tarko et al. ..... 294/143
6,032,999 * 3/2000 York et al. ..... 294/143

* cited by examiner

*Primary Examiner*—Leslie A. Braun
*Assistant Examiner*—A. Joseph Wujciak
(74) *Attorney, Agent, or Firm*—William Weigl

(57) ABSTRACT

A golf club carrier having opposing sides supporting clubs horizontally on clips has a first condition resting on the ground with its legs spread and only feet of the unit contacting the ground, and a second horizontally-collapsed condition which is assumed as soon as the carrier is lifted from the ground. The golfer can carry the unit with an arm hanging freely at his or her side with little or no concern of the carrier contacting his or her legs or trousers while walking. An actuator extending below the rest of the unit comes into contact with the ground when next stopping to take a golf shot, and this actuator automatically spreads the legs to open the unit as its legs contact and are supported on the ground.

8 Claims, 3 Drawing Sheets

GOLF CLUB CARRIER AND STAND

This invention relates to a gravitationally-collapsible stand that may be expanded automatically by pressing an actuator member at its lower end into contact with a supporting surface on which the stand is to become free standing. One intended use is for hand-carrying of golf clubs on legs of the stand, and merely temporarily propping the stand upright on the ground whenever a specific club is removed from the stand and used for taking a golf shot.

BACKGROUND OF THE INVENTION

Most non-bag golf club carriers on the market typically have a single pointed barb at the bottom which sticks into the ground to hold the carrier upright while using a club. Particularly in a dry summer, however, such carriers become somewhat useless when the ground can become so hard that it is nearly impossible to pierce it to prop the carrier. The easiest time to use such a barbed carrier is when the ground is soft enough to be easily pierced to the depth necessary to stand the carrier upright.

Several carriers are also known to have four legs, which enables them to stand freely without having to pierce the ground. These are useful regardless of ground hardness condition. Examples of such carriers are U.S. Pat. No. 4,666,038 issued to Minneman and U.S. Pat. No. 4,036,416 issued to Lowe. The former shows a molded plastic carrier with two sides that are hinged together at the top, and the sides are spread apart to form a stand when about to use a club. One side is longer than the other so that its bottom feet may be made to contact the ground and the handle then manipulated to move the other side laterally away from the first side. It then becomes tent-like and free standing on its feet. Lowe '416 has a two-sided inverted V carrier with a pivotal and lockable shelf interconnecting the two sides. Apparently the carrier is intended to remain in the spread condition while in use, otherwise, wing nuts would have to be fastened and loosened each time the carrier was set onto and removed from the ground at each time a club is swung. Obviously, to carry the unit in spread-legged fashion while on the golf course would require the user to hold it out away from his body while walking, possibly tiring his arms. Otherwise, one side of the unit would come into contact with the person's legs on occasion while walking. This would not only be a nuisance, but can dirty one's trousers and possibly has a potential to trip the individual.

Many styles of hand-carried golf bags include a pair of legs that prop the bag at an angle when resting the bag bottom on the ground. These legs are forced into a spread condition whenever an actuator adjacent the bottom of the bag releases a capturing element by being pressed against the ground. After making a shot, the player lifts the bag to remove the actuator from ground-contacting position, and the legs automatically fold back against the bag. To my knowledge, the approach of spreading legs outwardly and automatically returning then to a retracted position has only been employed with golf bags, and not with the type of golf club carrier where clubs are carried horizontally on the sides of the carrier.

SUMMARY OF THE INVENTION

A golf club carrier having opposing sides supporting clubs horizontally on clips has a first condition resting on the ground with its legs spread and only feet of the unit contacting the ground, and a second horizontally-collapsed condition which is assumed as soon as the carrier is lifted from the ground. The golfer can carry the unit with an arm hanging freely at his or her side with little or no concern of the carrier contacting his or her legs or trousers while walking. An actuator extending below the remainder of the unit comes into contact with the ground when next stopping to take a golf shot, and this actuator automatically spreads the legs to open the unit as its legs come into contact with and are supported on the ground.

A principal object of the invention is to provide a horizontally-collapsible stand which can be hand carried from one location to another, placed onto a supporting surface, and have legs thereof automatically spread into a free-standing supporting position of the stand.

An ancillary object is to have the stand automatically return to its horizontally-collapsed condition upon lifting the stand from the supporting surface.

A further object is to provide such a stand for use in carrying golf clubs on opposite sides thereof when playing a round of golf or practicing at a golf driving range.

Other objects and advantages will become apparent from the following description in which reference is made to the accompanying drawings.

DESCRIPTION OF THE PREFERRED EMBODIMENT

Figure 1:
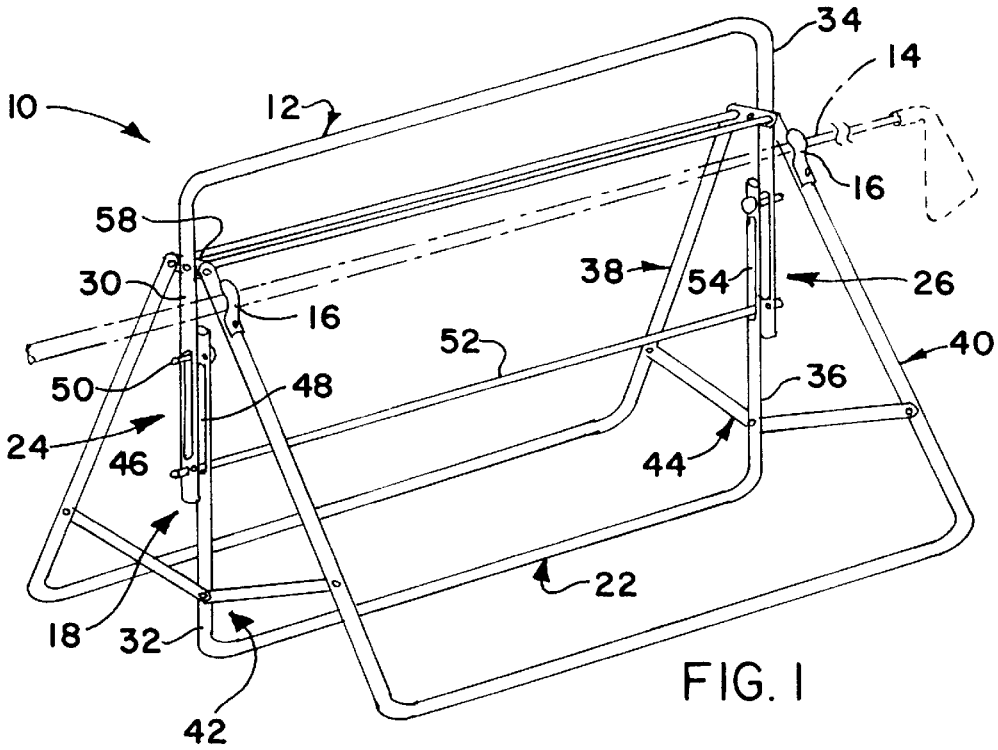
FIG. 1 is a simplified isometric view of the club carrier as its rests on the ground.

While the stand or carrier 10 of FIG. 1 may have uses other than as a golf club carrier as is depicted in the drawings, such other uses of its elements will become apparent and need not be described here. One example of such other use could be as a sawhorse with a handle member 12 of the carrier being substituted for by a flat top surface of the sawhorse.

The handle 12 member is preferably U-shaped and extends the full horizontal length of the carrier 10, so that the base of the U can be hand-supported anywhere along its length to obtain best balance of the unit while carrying clubs such as 14, only one on which is shown. Since it is well known from existing devices that a plurality of clubs can be carried on opposite sides of the carrier 10, and since any form of clips 16 can be used to hold the club shafts in place, they are only nominally shown herein. It is to be understood that the disclosed unit can carry a half-dozen to a dozen clubs, depending on its vertical depth. Likewise, the clips 16 are usually U-shaped, either specially designed or purchased off the shelf. Since they are not an essential part of this invention, they are shown herein only very simply as being riveted to their supporting elements.

An expandible and contractible actuating frame 18, preferably rectangular with rounded corners, consists of the inverted U-shaped handle member 12, a U-shaped actuator member 22 and first and second telescoping elements 24 and 26 interconnecting the handle member 12 and actuator member 22, respectively. The term "telescoping" as used herein is broader than its normal definition, merely implying that the base portion of the U of the handle member 12 of and the base of the U of the actuator member 22 are movable laterally toward and away from each other. The telescoping elements 24 and 26 may be designed as shown herein or may possibly be other more commonly recognized telescoping forms such as a sliding tube within a tube, much like a trombone slide. The telescoping element 24 interconnects a first leg 30 of member 12 with a first leg 32 of member 22. The telescoping element 26 interconnects a second leg 34 of member 12 with a second leg 36 of member 22. By telescoping the legs of the actuating frame 18 handle and actuator members 12 and 22 toward and away from one another, the rectangle formed thereby can be moved relatively for purposes of spreading and contracting club support members 30 and 40 by means of sets 42 and 44 of spreader links as will soon be described. It should be noted that, in use, the actuating frame 18 remains vertical or nearly so at all times. It compresses in size vertically as the base of member 22 contacts a supporting surface when the carrier is lowered, and expands as the member 12 is lifted to remove the carrier 10 from the ground. Expansion is accomplished by gravity due to ease of telescoping and the weight of the club support members 38 and 40 and the clubs carried by the clips 16 on the legs of the members 38 and 40.

Figure 2:
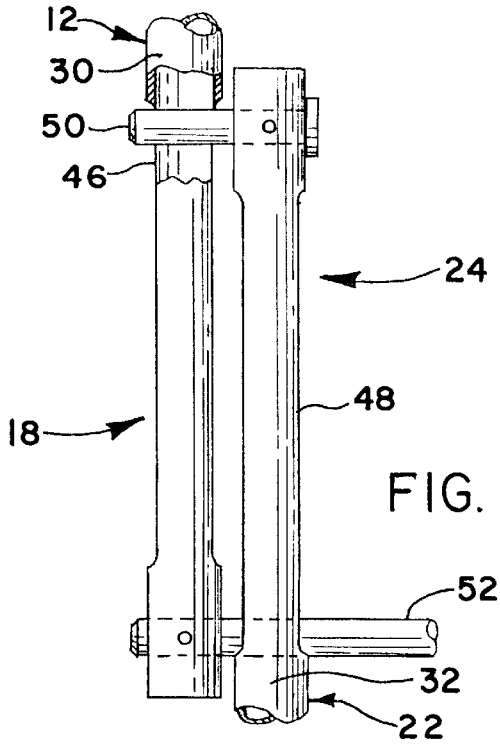
FIG. 2 is an enlarged view of one form of telescoping element that may be utilized to activate spreading and contracting the sides of the carrier relatively to a handle.

One preferred form of telescoping element 24, 26 is shown in enlarged detail in FIG. 2. The legs 30 and 32 are closely laterally spaced with respective slots 46 and 48 in alignment. A guide pin 50 is fastened by any means to the leg 32 and extends into and through the slot 46. A guide rod 52 extends from leg 30 to leg 34 and is fastened by any means such as pinning to the legs. The rod 52 passes freely through the slot 48 and a corresponding slot 54 in telescoping element 26. In essence, as viewed in FIG. 2, if pin 50 and rod 52 are permitted to move toward each other, the actuating frame 18 expands. This is enabled by the slots 46 and 48, which together with the pin and rod act to stabilize the parallelism of the legs 30 and 32. The amount of movement of pin 50 toward rod 52 is limited by pin 50 contacting the bottom of slot 46 while the top of slot 48 engages against rod 52. The legs of the handle member 12 and the actuator member 2 thus are always maintained parallel.

Figure 3:
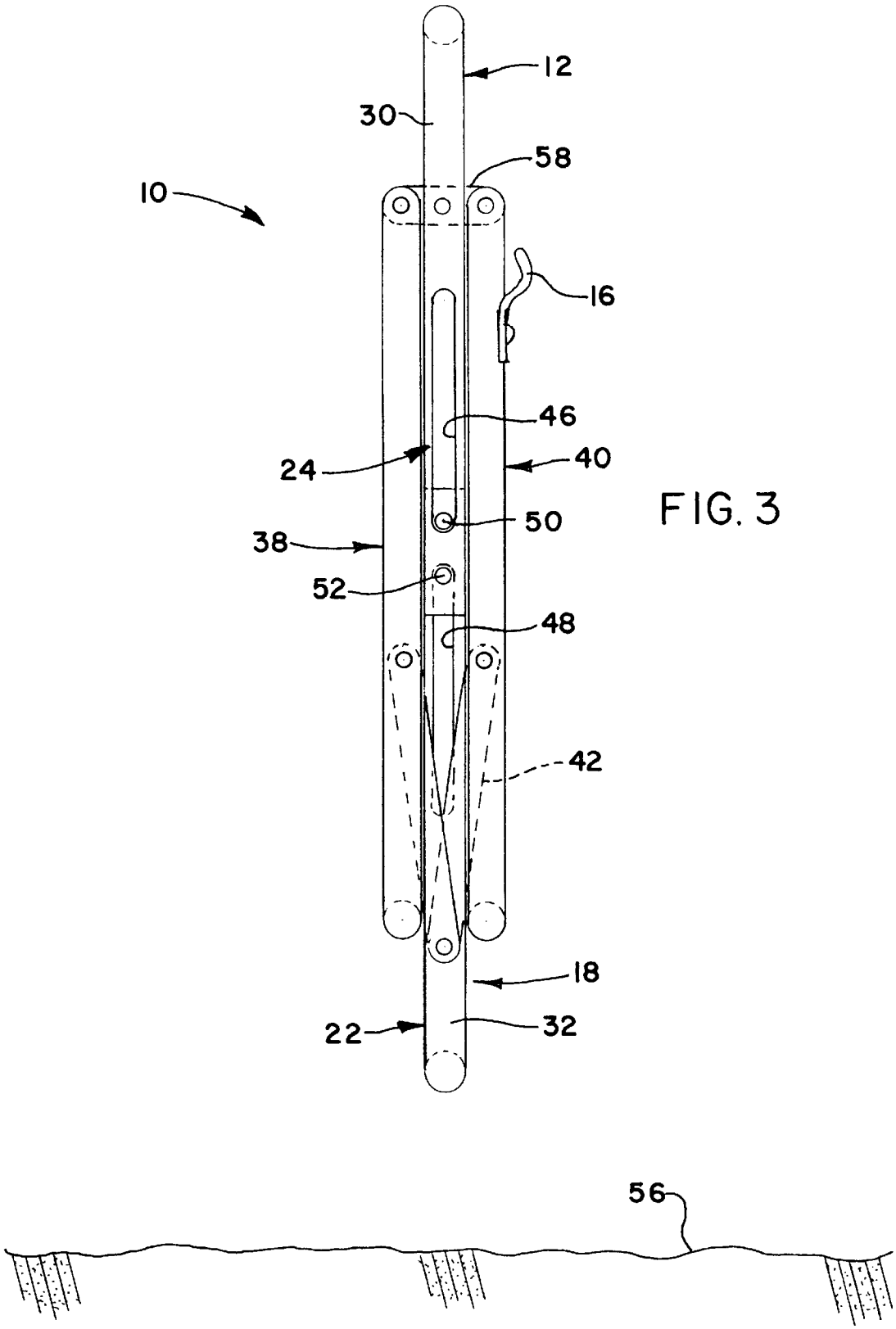
FIG. 3 is a vertical end view of the carrier as it would be carried by the user, with the user walking toward or away from the viewer.
Figure 4:
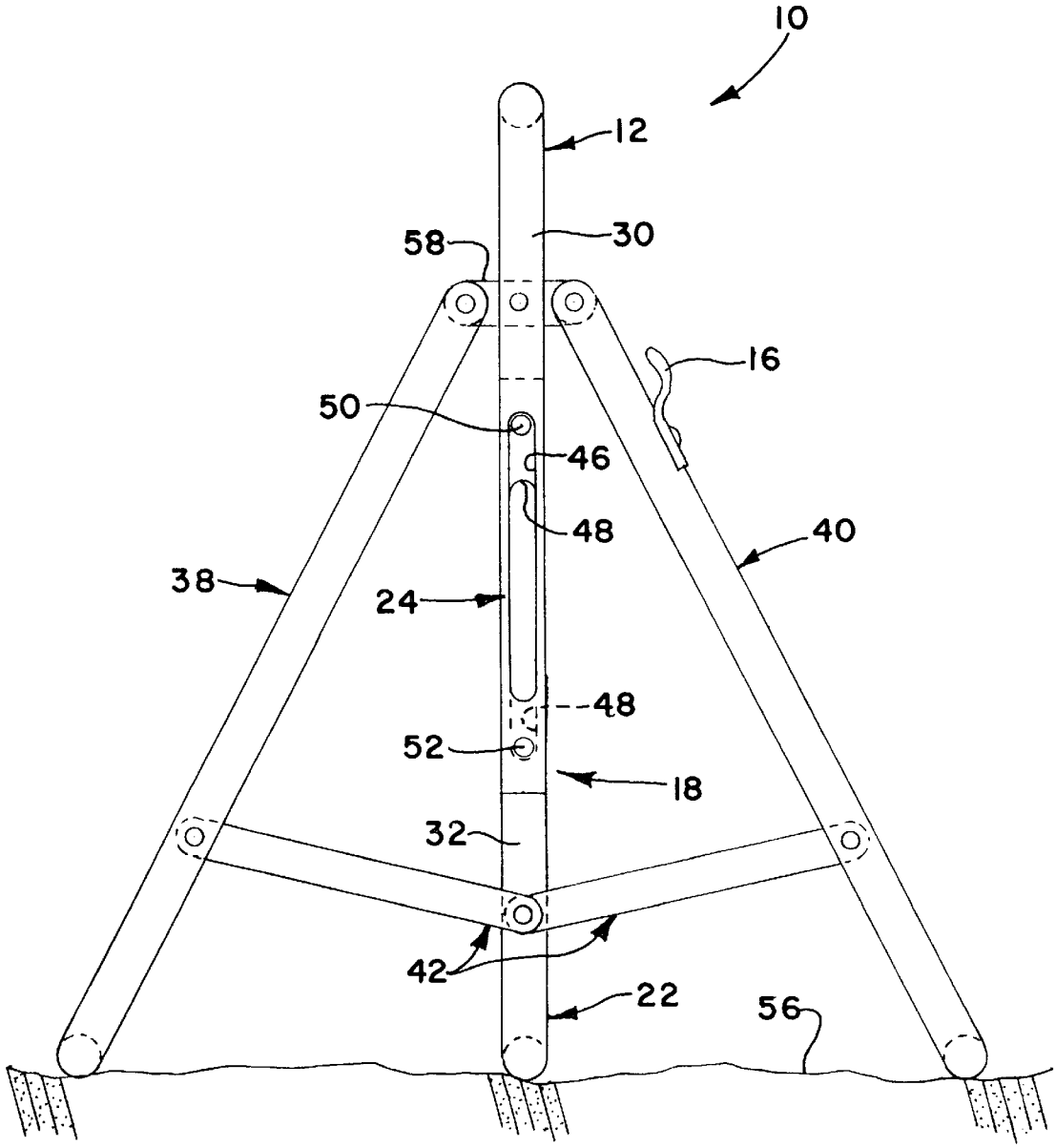
FIG. 4 is a vertical end view of the carrier after it has been placed on and rests on a supporting surface such as the ground.

Cross-referring now between FIGS. 3 and 4, a person walking with the stand 10 off the ground will find it collapsed horizontally as in FIG. 3. Then, when stopping to make a golf shot, the unit is lowered to the ground 56 to expand the club support members 38 and 40 into their positions shown in FIG. 4. This is accomplished by the base of the actuator member 22 contacting the ground 56 and causing the sets of spreader links 42 and 44 to move the members 38 and 40 outwardly as the actuating frame 18 is reduced in size. The links 42 and 44 are pivotally connected to the first and second legs 32 and 36 of the member 22. The top free ends of the legs of the club support members are preferably loosely pivoted to opposing ends of rocker arms 58 and 60. The arms 58 and 60 are freely pivotally connected to the legs 30 and 34 of the handle member 12. Thus, as the actuator member 22 base moves upwardly as allowed by the telescoping elements 24 and 26, the sets of spreader links 42 and 44 swing the club support members 38 and 40 outwardly. This becomes possible by virtue of the upper ends of the club support members 38 and 40 being restrained from also moving due to the rocker arms 58 and 60 being mounted to the legs 30 and 34. The rocker arms allow slight compensation of the club support members to the ground, particularly where the ground is not level or the carrier is being placed on a slight slope. The rocker arms can pivot relatively to the legs 30 and 34, and each of the club support members is capable of pivoting relative to the distal ends of the rocker arms 58 and 60.

The freedom of movement of all of the interconnecting points makes for easy carrier collapsing when the carrier has its club replaced and is lifted from the ground to be carried to its next stop. This freedom also makes for easy spreading of the legs as the carrier is lowered to the ground at the next location. If the ground is not level at that next point, the rocker arms will compensate as the unit is lowered to the ground. In some instances, as the unit assumes the rest position of FIG. 4, the frame 18 may be somewhat off a true vertical line, but still rest firmly on the ground. This is desirable to maintain sound stability of the carrier as a club is being removed from the clips, particularly if the clips are of a design which require firm removal to lift it out and off the carrier.

Various changes may be made in the details of the construction without departing from the spirit and scope of the claims.

Having described the invention, what is claimed is:

1. A golf club carrier comprising:

a) an inverted U-shaped handle member having first and second parallel legs and a base portion extending between and perpendicular to said legs;

b) an upright U-shaped actuator member having first and second parallel legs and a base portion extending between and perpendicular to its legs;

c) a first set of telescoping elements operatively interconnecting each of said first legs and a second set of telescoping elements operatively interconnecting each of said second legs, said telescoping elements enabling limited range lateral movement of the base portions of said handle member and said actuator member in unison toward and away from each other;

d) a hinge joint on each leg of said handle member intermediate its base portion and the telescoping elements thereof;

e) a pair of U-shaped club support members on opposite sides of said handle member and actuator member, each of which club support members has equal length parallel first and second legs spaced apart generally the same width as the handle member legs, with the distal ends of the first legs of both said club support members being pivotally connected to the handle member first leg hinge joint and the distal ends of the second legs of both said club support members being pivotally connected to the handle member second hinge joint;

f) a plurality of sets of shaft support members on each of the club support member legs for supporting golf clubs in a fashion spanning said club support member legs and generally parallel to the base of the handle member;

g) a hinge joint on each leg of said actuator member intermediate its base portion and its associated portion of the telescoping element thereof;

h) a hinge joint on each leg of both club support members, said club support member hinge joints being spaced from the base portions thereof a greater distance than the distance between the actuator member hinge joint and the base portion thereof;

i) a first pair of spreader links freely interconnecting the hinge joint of the actuator member first leg with a hinge joint of each first leg of both club support members; and j) a second pair of spreader links freely interconnecting the hinge joint of the actuator second leg with a hinge joint of each second leg of both club support members; said spreader links all being of the same length, whereby, while said handle member is being hand carried by means of its base portion, said actuator member telescopes downwardly of its own weight and the weight of golf clubs being carried on the club support members and thereby causes said spreader links and said club support members to collapse inwardly toward each other and further whereby, when the handle member is lowered into contact with a supporting surface, the actuator member causes the links to spread the base portions of the club support members apart a distance sufficient to enable the carrier to become essential vertically free standing feet on the supporting surface.

2. The golf club carrier set forth in claim 1 wherein each hinge joint on the legs of the handle member comprises a cross rocker arm, and wherein said cross rocker arm has opposed distal ends thereof pivotally supporting the distal ends of the legs of the club support members.

3. The golf club carrier set forth in claim 2 wherein said cross rocker arms are pivotally mounted on the legs of the handle member so as to enable the club support members to float and adjust the carrier to an unlevel supporting surface.

4. The golf club carrier set forth in claim 1 wherein each set of telescoping elements includes finite-length aligned slots in the legs of the handle member and actuator member, and pin stop means, one on each leg of each telescoping element passing through the slot of the adjacent leg and thereby limiting the amount of telescoping to the slot length.

5. The golf club carrier set forth in claim 4 wherein the base of the actuator member is shorter than the base of the handle member an amount allowing the legs of the actuator member to be placed inwardly of the legs of the handle member when the respective slots of the handle member and the actuator member are in alignment to enable telescoping.

6. A stand comprising:

a) an inverted U-shaped member having first and second parallel legs and a base portion extending between and perpendicular to said legs;

b) an upright U-shaped actuator member having first and second parallel legs and a base portion extending between and perpendicular to its legs;

c) a first set of telescoping elements operatively interconnecting each of said first legs and a second set of telescoping elements operatively interconnecting each of said second legs, said telescoping elements enabling limited range lateral movement of the base portions of said inverted member and said actuator member in unison toward and away from each other;

d) a hinge joint on each leg of said inverted member intermediate its base portion and the telescoping elements thereof;

e) a pair of support leg members on opposite sides of said inverted member and actuator member, each of which supporting leg members has spaced apart equal length parallel first and second legs, with the distal ends of the first legs of both said supporting leg members being pivotally connected to the inverted member first leg hinge joint and the distal ends of the second legs of both said supporting leg members being pivotally connected to the inverted member second hinge joint;

f) a hinge joint on each leg of said actuator member intermediate its base portion and its associated portion of the telescoping element thereof;

g) a hinge joint on each leg of both supporting leg members, said supporting leg member hinge joints being spaced from the base portions thereof a greater distance than the distance between the actuator member hinge joint and the base portion thereof;

h) a first pair of spreader links freely interconnecting the hinge joint of the actuator member first leg with a hinge joint of each first leg of both supporting leg members; and i) a second pair of spreader links freely interconnecting the hinge joint of the actuator second leg with a hinge joint of each second leg of both supporting leg members; said spreader links all being of the same length, whereby said actuator member may telescope downwardly of its own weight and thereby cause said spreader links to collapse inwardly toward each other and further whereby, when the inverted member is lowered toward and into contact with a supporting surface, the actuator member causes the links to spread the base portions of the supporting leg members apart a distance sufficient to enable the stand to become free standing on the supporting leg members.

7. The golf club carrier set forth in claim 6 wherein each set of telescoping elements includes finite-length aligned slots in the legs of the inverted member and actuator member, and pin stop means, one on each leg of each telescoping element passing through the slot of the adjacent leg and thereby limiting the amount of telescoping to the slot length.

8. The golf club carrier set forth in claim 7 wherein the base of the actuator member is shorter than the base of the inverted member an amount allowing the legs of the actuator member to be placed inwardly of the legs of the inverted member when the respective slots of the inverted member and the actuator member are in alignment to enable telescoping.

* * * * *

UNITED STATES PATENT AND TRADEMARK OFFICE

CERTIFICATE OF CORRECTION

PATENT NO. : 6,179,256 B1
DATED : January 30, 2001
INVENTOR(S) : Clifford M. Utterback It is certified that error appears in the above-identified patent and that said Letters Patent is hereby corrected as shown below:

Claims 7 and 8,
Line 1, "The golf club carrier" should read -- The stand --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*